US012753557B2

(12) United States Patent
Kesler et al.

(10) Patent No.: US 12,753,557 B2
(45) Date of Patent: Oct. 6, 2026

(54) ROADWAY SAFETY DEVICE

(71) Applicant: Argo Corp, Inc., Jackson, MI (US)

(72) Inventors: Jayson Kesler, Riverton, UT (US); Stacey Kesler, Riverton, UT (US)

(73) Assignee: Argo Corp, Inc., Jackson, MI (US)

( * ) Notice: Subject to any disclaimer, the term of this patent is extended or adjusted under 35 U.S.C. 154(b) by 0 days.

(21) Appl. No.: 18/759,885

(22) Filed: Jun. 30, 2024

(65) Prior Publication Data

US 2025/0230616 A1 Jul. 17, 2025

Related U.S. Application Data

(63) Continuation of application No. 17/537,236, filed on Nov. 29, 2021, now Pat. No. 12,060,686.

(60) Provisional application No. 63/121,648, filed on Dec. 4, 2020.

(51) Int. Cl.

| | |
|---|---|
| ***G09F 15/00*** | (2006.01) |
| ***E01F 9/631*** | (2016.01) |
| ***E01F 9/669*** | (2016.01) |
| ***E01F 15/08*** | (2006.01) |

(52) U.S. Cl.
CPC ..... *E01F 9/669* (2016.02); *E01F 9/631* (2016.02); *E01F 15/088* (2013.01)

(58) Field of Classification Search
CPC ..... E01F 9/646; G09F 15/0056; G09F 7/18; G09F 7/22; G09F 15/0037; G09F 15/00; Y10T 403/32557
See application file for complete search history.

(56) References Cited

U.S. PATENT DOCUMENTS

| | | | | |
|---|---|---|---|---|
| 1,436,544 | A * | 11/1922 | Starr | A47G 1/14 40/497 |
| 3,235,214 | A * | 2/1966 | Sprung | E01F 13/123 40/607.1 |
| 3,680,448 | A | 8/1972 | Ballingall | |
| 3,787,922 | A | 1/1974 | Foy | |
| 3,851,616 | A | 12/1974 | Brown | |
| D253,637 | S | 12/1979 | Welbourne | |
| 4,486,117 | A | 12/1984 | Blau | |
| 4,714,220 | A | 12/1987 | Hillstrom | |
| 5,012,603 | A | 5/1991 | Elcock | |
| 5,408,774 | A | 4/1995 | Grewe | |
| 5,732,911 | A | 3/1998 | Kulp | |
| 5,775,833 | A | 7/1998 | Little | |
| 5,901,937 | A | 5/1999 | Compeau | |
| 6,079,683 | A | 6/2000 | Lin | |
| 6,315,251 | B1 | 11/2001 | Stoudt | |
| 6,430,854 | B1 | 8/2002 | Szentgyorgyi | |
| 6,430,855 | B1 | 8/2002 | Gertz | |
| 6,467,747 | B1 | 10/2002 | Ellsworth | |
| 6,502,365 | B1 | 1/2003 | Legrand | |
| 6,735,921 | B2 * | 5/2004 | Oberhofer | B32B 17/10036 52/786.13 |

(Continued)

*Primary Examiner* — Shin H Kim
(74) *Attorney, Agent, or Firm* — BATEMAN IP; Randall B. Bateman

(57) ABSTRACT

A roadway safety device includes one or more spacers which engage a falling arm attached to a sign so as to lift the sign relative to a structure on which a housing bracket attached to the arm rests. The roadway safety device may include a spacer which dampens the fall of the arm and which holds the arm at an upward angle to make the sign more visible to drivers.

20 Claims, 6 Drawing Sheets

(56) References Cited

U.S. PATENT DOCUMENTS

| | | | | |
|---|---|---|---|---|
| 7,243,450 | B2 | 7/2007 | Dicke | |
| 7,509,921 | B2 | 3/2009 | Dicke | |
| 7,726,056 | B2 | 6/2010 | Brodie | |
| 7,735,639 | B1 | 6/2010 | De Mare | |
| 8,650,783 | B2 | 2/2014 | Brown | |
| 8,689,938 | B2 | 4/2014 | Kenton | |
| 9,617,747 | B2 | 4/2017 | Seto | |
| 9,714,670 | B2 * | 7/2017 | Header | E04D 13/10 |
| 10,641,300 | B2 * | 5/2020 | Header | F16B 2/065 |
| 11,725,679 | B2 * | 8/2023 | Header | F24S 25/615 248/237 |
| 2002/0020119 | A1 | 2/2002 | Oberhofer | |
| 2005/0247837 | A1 | 11/2005 | Spencer | |
| 2007/0028492 | A1 | 2/2007 | Padiak | |
| 2007/0241255 | A1 | 10/2007 | Dvoracek | |
| 2009/0320396 | A1 | 12/2009 | Knudsen | |
| 2011/0154703 | A1 | 6/2011 | Petrovic | |
| 2014/0086680 | A1 | 3/2014 | Header | |
| 2015/0093190 | A1 | 4/2015 | Header | |
| 2015/0121733 | A1 | 5/2015 | Oberkofler | |
| 2016/0098947 | A1 | 4/2016 | Smith | |
| 2017/0248161 | A1 * | 8/2017 | Header | F16M 13/022 |
| 2020/0191179 | A1 * | 6/2020 | Header | F24S 25/615 |
| 2022/0389737 | A1 | 12/2022 | Glick | |
| 2025/0230616 | A1 | 7/2025 | Kesler et al. | |

* cited by examiner

FIG. 5
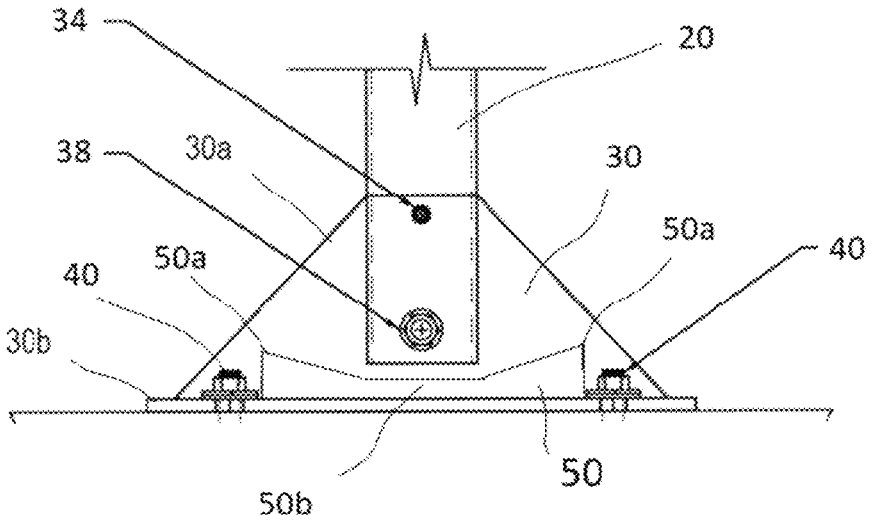
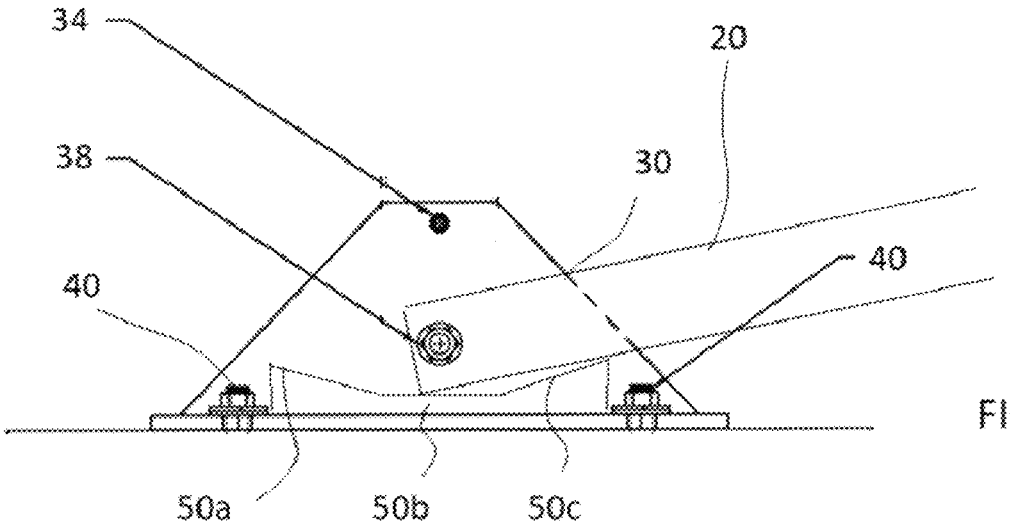
FIG. 6

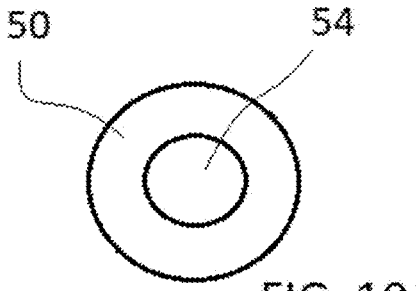
FIG. 10
FIG. 11
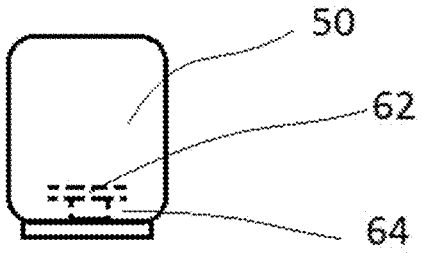
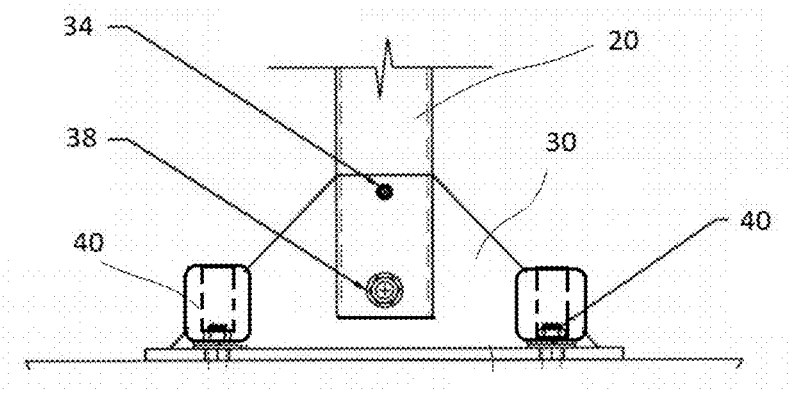
FIG. 12

ROADWAY SAFETY DEVICE

BACKGROUND

State of the Art

The present invention relates to a device and a method of use for improving roadway safety. More particularly, the present invention relates to a device and method for reducing accidents involving road signs.

Field of Art

Road signs are used for a variety of purposes along a road. Some provide location information, while others provide safety information such as speed limits, warnings of hazards, and other information needed for safety.

Many roads also include a barrier. Some barriers are permanent and are often referred to as poured in place walls. Other walls are formed by cast concrete segments that can brought in and moved if desired. The barriers are designed to keep traffic from passing over into oncoming lanes, to provide a barrier keeping automobiles off of sidewalks and the like, or otherwise to direct traffic back into the travel lanes if someone loses control of their automobile. Some concrete barriers have a first, lower portion disposed at one angle and a second, upper portion disposed at a higher angle. These are commonly referred to as jersey barriers or type F barriers. Other barriers are formed to has a continuous slope from top to bottom. For brevity, poured in place walls, jersey barriers and similar dividers will be referred herein as barriers. As such the broad term barriers shall include poured in place, jersey barriers and the like.

A concrete barrier are typically at least 32 inches (81.28 cm) tall, and are commonly 36 to 48 inches (91.44 to 121.92 cm) tall. Because of their location along the side of the road, it is common for road signs to be positioned on top of the concrete barrier. These may include speed limit signs, signs regarding high occupancy vehicle (HOV) lanes, as well as signs regarding exists, and potential road hazards.

As shown in FIG. 1, a barrier 4 (such as a concrete jersey wall or continuous slope wall) is placed or formed on the ground 8. When a sign 24 is mounted on the barrier 4, a bracket 12 extends from opposing side walls of their jersey barrier and over the top to provide a connector for an arm 20 which holds the sign 24. The bracket 12 is held in place by a screw or bolt 16 which is driven into the barrier 4.

Such a configuration has been commonly used on freeways and highways across the United States. It has been found, however that the bracket 12 and bolt 16 can be hazardous in certain accidents. When a car impacts a concrete barrier at the location of the bracket 12, the bracket and bolt 16 can engage the front quarter panel and/or the hood of the vehicle. This can result in large pieces of metal being driven into the passenger compartment of a vehicle.

In an attempt to alleviate such harms, a new form of bracket was created. As shown in FIG. 2, a sign 24 can be connected to a barrier 4 by a housing bracket 30 which is attached to the top of the barrier by one or more screws or bolts 40. The arm 20 may be attached to the housing bracket 30 by a pivot bolt 38 and a sheer bolt 34 disposed in a sidewall 30*a* of the housing. The idea behind the sign mounting method shown in FIG. 2 is to allow arm 20 and 24 to collapse if struck by a vehicle, etc. It has been found, however, that in violent windstorms the sheer bolt 34 may give way and allow the arm 20 and sign 24 to fall.

Regardless of whether the arm 20 and sign 24 give way because of an accident or high winds, the device which was viewed as providing additional safety can actually be more of a threat to safety than its predecessors. For example, FIG. 3 shows a side view of a housing bracket 30 with one side removed. The bottom wall 30*b* of the housing bracket 30 may be attached to a concrete barrier (not shown) by two or more bolts which extend into the barrier. If the sheer bolt 38 is broken, the arm 20 to which the sign 24 is attached is able to rotate outwardly and downwardly about the bolt 38. This results in the arm 20 and sign 24 laying substantially parallel to the top of the barrier as shown in FIG. 4.

While the attachment configuration shown in FIGS. 2 through 4 were designed to overcome safety problems of the configuration shown in FIG. 1, it will be readily apparent to those in the field of the invention that the road sign in the down position actually creates a more significant hazard. The sign 24 may stick out approximately two to three feet (60.96 to 91.44 cm) from either side of the jersey barrier. The sign 24, which is now lying flat (generally horizontal), may be only one to three inches (2.54 to 7.62 cm) thick, thereby making it much harder for a driver to see. Additionally, the color of metal used on structures to support a sign are often somewhat similar to the grey color often present due to the concrete in a jersey barrier. In other words, a sign 24 which has fallen flat is difficult to see, especially when positioned near the height of a driver's head and when coming at a high rate of speed. Because the downed sign will typically be about three to four feet (91.44 to 121.92 cm) above the roadway, if a person crashes into or even grazes the barrier 4, simply pulls over due to an emergency or is pulled over by a police officer, there is a real risk that the sign will impact the car above the hood and below the top of the cabin. This can seriously injure or even potentially decapitate the driver or a passenger depending on what side of the street the barrier 4 is placed on. This is especially so when the driver is being pulled over, as he or she will tend to be paying less attention looking forward and more attention to the lights in the rear-view mirror.

While police officers will typically report downed signs so that road crews may get them fixed as quickly as possible, there can be hundreds of downed signs after a violent windstorm or hurricane. Thus, it can take days or weeks to reorient the arms and place a new sheer bolt 34 in place. To address this problem, some localities have selected bolts having a higher sheer rating so that the sheer bolts are less likely to break in a windstorm. However, this also results in a sign which is less likely to give way if hit by a semi-truck or a vehicle during an accident. Thus, there is a need for an improved safety device use which reduces the risk of a person being injured by a safety sign.

SUMMARY OF THE INVENTION

The following summary of the present invention is not intended to describe each illustrated embodiment or every possible implementation of the invention, but rather to give illustrative examples of application of principles of the invention.

In accordance with one aspect of the present disclosure, a spacer is mounted in a housing bracket. The spacer is designed to prevent the sign from lying vertical if the shear bolts have been sheared.

In accordance with another aspect of the present disclosure, the spacer formed from a resilient or semi-resilient material is such that the spacer helps to absorb some of the impact of the sign falling.

In accordance with yet another aspect of the present disclosure, the spacer is of sufficient height that the sign is positioned at least 20 degrees above horizontal so as to increase visibility of the sign. In a more preferred embodiment, the fallen sign is positioned at least 30 degrees above horizontal so as to further increase visibility of the sign and to lift the sign to a height where it is less likely to impact an automobile. In a most preferred embodiment, the spacer holds the arm and/or the sign at an angle between 35 and 50 degrees above horizontal.

In accordance with another aspect of the present disclosure, the spacer may be configured to hold the sign at an elevation in which the bottom of the sign is higher than the average automobile.

BRIEF DESCRIPTION OF THE DRAWINGS

Various embodiments of the present disclosure are shown and described in reference to the numbered drawings wherein:

FIG. 5 shows the use of a spacer in accordance with the teaching of the present disclosure;

FIG. 6 shows a side view of similar to that of FIG. 5, after the sheer bolt has been sheered;

FIG. 10 shows a top view of an alternate spacer;

FIG. 11 shows a side view of the spacer of FIG. 10;

FIG. 12 shows a side view of the spacer of FIGS. 10 and 11 mounted on a housing bracket.

Figure 1:
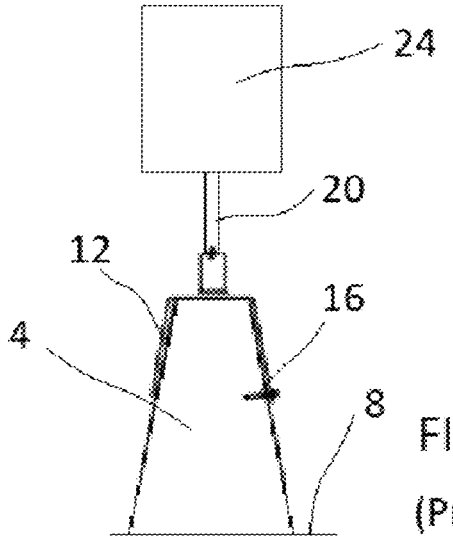
FIG. 1 (Prior Art)
FIG. 1 illustrates a mechanism for holding a road sign in accordance with teachings of the prior art.

It will be appreciated that the drawings are illustrative and not limiting of the scope of the invention which is defined by the appended claims. The embodiments shown accomplish various aspects and objects of the invention. It will be appreciated that it is not possible to clearly show each element and aspect of the present disclosure in a single figure, and as such, multiple figures are presented to separately illustrate the various details of different aspects of the invention in greater clarity. Similarly, not all configurations or embodiments described herein or covered by the appended claims will include all of the aspects of the present disclosure as discussed above.

DETAILED DESCRIPTION

Various aspects of the invention and accompanying drawings will now be discussed in reference to the numerals provided therein so as to enable one skilled in the art to practice the present invention. The skilled artisan will understand, however, that the methods described below can be practiced without employing these specific details, or that they can be used for purposes other than those described herein. Indeed, they can be modified and can be used in conjunction with products and techniques known to those of skill in the art in light of the present disclosure. The drawings and the descriptions thereof are intended to be exemplary of various aspects of the invention and are not intended to narrow the scope of the appended claims. Furthermore, it will be appreciated that the drawings may show aspects of the invention in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element of the invention to a single embodiment, rather the element may be included in other, or all embodiments discussed herein.

Furthermore, the described features, structures, or characteristics of embodiments of the present disclosure may be combined in any suitable manner in one or more embodiments. In the following description, numerous specific details may be provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

Before the present invention is disclosed and described in detail, it should be understood that the present invention is not limited to any particular structures, process steps, or materials discussed or disclosed herein, but is extended to include equivalents thereof as would be recognized by those of ordinarily skill in the relevant art. More specifically, the invention is defined by the terms set forth in the claims. It should also be understood that terminology contained herein is used for the purpose of describing particular aspects of the invention only and is not intended to limit the invention to the aspects or embodiments shown unless expressly indicated as such. Likewise, the discussion of any particular aspect of the invention is not to be understood as a requirement that such aspect is required to be present apart from an express inclusion of that aspect in the claims.

It should also be noted that, as used in this specification and the appended claims, singular forms such as "a," "an," and "the" may include the plural unless the context clearly dictates otherwise. Thus, for example, reference to "a bracket" may include an embodiment having one or more of such brackets, and reference to "the target plate" may include reference to one or more of such target plates.

As used herein, the term "substantially" refers to the complete or nearly complete extent or degree of an action, characteristic, property, state, structure, item, or result to function as indicated. For example, an object that is "substantially" enclosed would mean that the object is either completely enclosed or nearly completely enclosed. The exact allowable degree of deviation from absolute completeness may in some cases depend on the specific context, such that enclosing the nearly all of the length of a lumen would be substantially enclosed, even if the distal end of the structure enclosing the lumen had a slit or channel formed along a portion thereof. The use of "substantially" is equally applicable when used in a negative connotation to refer to the complete or near complete lack of an action, characteristic, property, state, structure, item, or result. For example, structure which is "substantially free of" a bottom would either completely lack a bottom or so nearly completely lack a bottom that the effect would be effectively the same as if it completely lacked a bottom.

As used herein, the term "generally" refers to something that has characteristics of a quality without necessarily being exactly that quality. For example, a structure said to be generally vertical would be at least as vertical as horizontal, i.e., would extend 45 degrees or greater from horizontal. Likewise, something said to be generally circular may be rounded like an oval but need not have a consistent diameter in every direction.

As used herein, the term "about" is used to provide flexibility to a numerical range endpoint by providing that a given value may be "a little above" or "a little below" the endpoint while still accomplishing the function associated with the range.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Turning now to FIG. 1, there is shown an end view of a bracket 12 mounted on a concrete barrier 4 which may be resting on or formed on the ground 8 or some other substrate. It will be appreciated that barriers may come in a variety of cross-sections. For example, one common design uses flared lower portions to increase the surface area engaging the roadway and to help direct cars back into traffic. The barrier 4 shown in FIG. 1 is a continuous slope barrier with a bracket 12 attached thereto by a screw or bolt 16. The backet 12 may connect to an arm 20 which hold a sign 24 in place. This prior art design was deemed to be dangerous because the bracket 12 and the bolt 16 which attaches it to the barrier can engage the front quarter panel and/or the hood of a vehicle and drive it back toward the passenger cabin.

Figure 2:
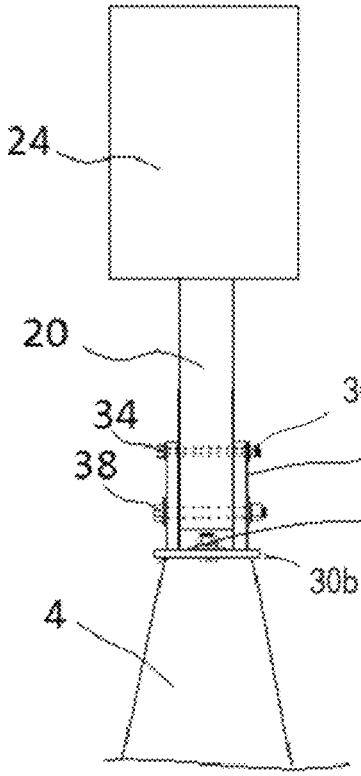
FIG. 2 (Prior Art)
FIG. 2 shows an alternate mechanism for holding a road sign in accordance with teachings of the prior art.
Figure 3:
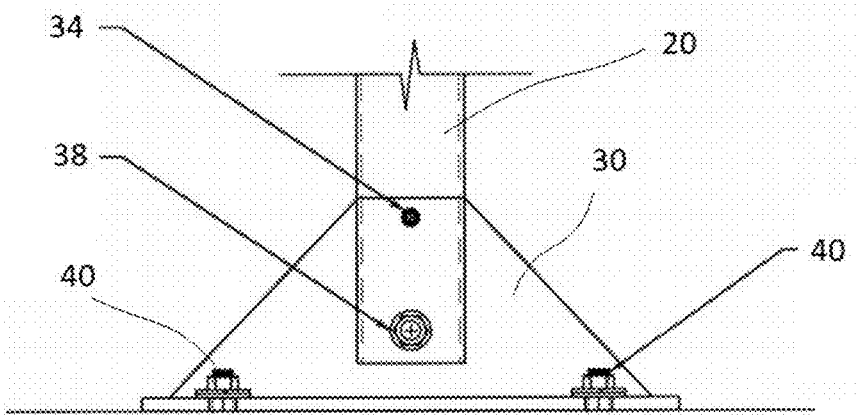
FIG. 3 (Prior Art)
FIG. 3 shows a close-up, side view of the mechanism of FIG. 2 with one side of the wall of the housing bracket removed so as to show the bottom of an arm.
Figure 4:
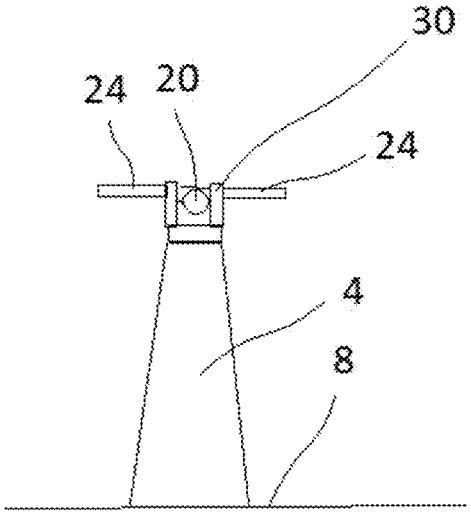
FIG. 4 (Prior Art)
FIG. 4 shows a view of the mechanism of FIGS. 2 and 3 after the sheer bolt has been sheered so that the sign is in a horizontal plane.

FIGS. 2-4 show an alternate prior art configuration which was designed to remove the likelihood of a car impacting the bracket 12 or bolt 16. The housing bracket 30 is attached to the top of a barrier by one or more bolts 40. If the sign is impacted with sufficient force, a shear bolt 34 will break, allowing the sign 24 and arm 20 connecting the sign to the housing bracket 30 to pivot down around the pivot bolt 38. This can occur during an accident, or if a vehicle passing by has some structure extending out too far, such as someone moving tree branches which are extending out beyond the side of the vehicle. A sign can also go down if a storm brings sufficient wind speeds to apply sufficient force to the sign to overcome the strength of the sheer bolt 34.

While the configuration shown in FIGS. 2 through 4 was designed to promote safety, the end view shown in FIG. 4 shows a situation in which the design can actually be more dangerous. If the sign 24 has been knocked over, the arm 20 lays generally horizontal, as does the sign. In this configuration, the sign 24 ends up resting on the concrete barrier 4 or slightly above the jersey barrier-typically 32-42 inches (81.28 cm to 106.68 cm) about the roadway. The fallen sign has a substantially reduced profile (often only 2-4 inches (5.08 to 10.16 cm in height) and may have coloration not that different from the concrete barrier (galvanized steel vs. concrete grey). Thus, a portion of the sign may be sticking 2-3 feet (60.96 to 91.44 cm) out toward the roadway and yet be very difficult for a driver to see. For a person pulling off the side of the road to make a call, fix a flat, or to receive a speeding ticket, the metallic arm formed by the portion of the sign sticking out toward the roadway becomes a serious safety threat and may act as a guillotine cutting right through the front window and passenger cabin. Even if one is lucky enough to be in a raised vehicle in which the impact will be taken by the engine compartment, the sudden deceleration of one side of the vehicle can cause the vehicle to spin, with the rear portion of the vehicle rotating out into the drive lanes of traffic and potentially leaving the vehicle turned around facing oncoming traffic.

The present disclosure helps resolve these concerns by providing a spacer 50 which engages the arm 20 attached to the sign when the shear bolt 34 is sheared. Instead of allowing the arm 20 to fall all of the way horizontal, the spacer 50 engages the arm. This is advantageous because doing so may prevent the sign 24 from forcefully impacting the top of the jersey barrier where the top of the jersey barrier may damage the sign, or vice versa. In one preferred application, the spacer 50 may be made from a resilient or semi resilient material, such as a high-density polymer or other rubber-like material so that the spacer 50 takes some or all of the impact of the force/weight of the falling sign. This prevents damage to both the sign 24 and the top of the barrier 4.

Figure 7:
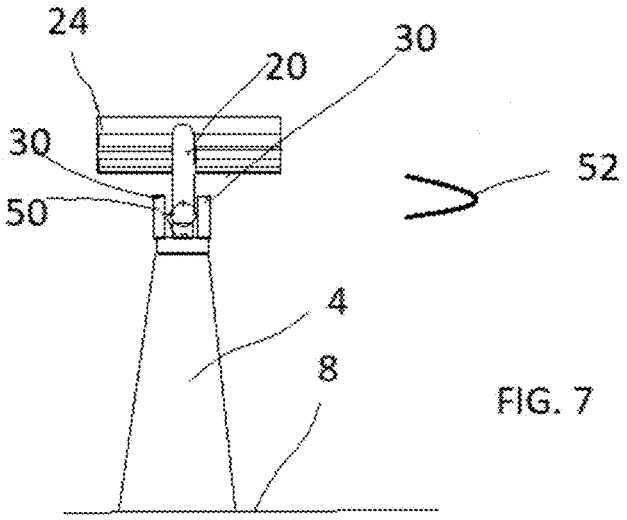
FIG. 7 shows an end view of the mechanism with the spacer shown in FIGS. 5 and 6 after the sheer bolt has been sheared and the sign come to rest.
Figure 8:
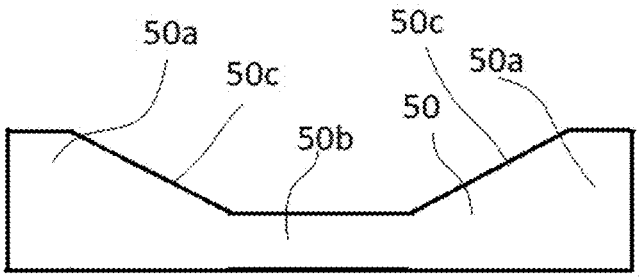
FIG. 8 shows a close-up side view of a spacer.
Figure 9:
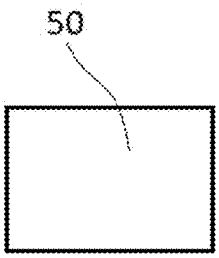
FIG. 9 shows a close-up end view of a spacer.

The spacer 50 preferably extends upwardly sufficiently that it engages and holds the arm 20 substantially above horizontal (i.e., at least 20 degrees toward the vertical) as shown in FIG. 6. In addition to preventing forceful impact between the sign 24 and the barrier 4 (it will be appreciated that it can be mounted on top of barriers made of other material as well), the position moves the sign 24 into the position shown in FIG. 7. As the sign 24 moves toward vertical, its profile increases, and it becomes much more easily seen and noticed by drivers. Additionally, light can be seen between the top of the barrier 4 and the bottom of the sign 24 (indicated at 52)—thereby making the two structures easier to distinguish. Depending on the length of the arm 20 and the thickness of the end of the spacer 50, the sign may be lifted sufficiently that it will pass over the top of most passenger cars, thereby substantially reducing the risk of harm.

The spacer 50 as shown in FIGS. 5, 6, 8, 9 and 13 is generally shaped to that the ends 50*a* are thicker than a middle portion 50*b*. As shown in FIGS. 5 and 6, the overall length of the spacer may be between six inches and 1.5 feet (15.24 to 45.72 cm) depending on the sign arm being used, but about 1 foot is most common. The middle portion 50*b* of the spacer 50 may be flat and in a typical embodiment may be, for example, 0.5 to 1.5 inches (1.72 to 3.81 cm) thick. The end portions 50*a* may be between two to ten times as thick as the middle portion 50*b*. In one current embodiment, the middle portion is about 1 inch thick, and the end portions are 3 inches thick with a tapering wall 50*c* disposed of an angle between 22 and 35 degrees depending on length. It will be appreciated that the angle of the tapering walls may be as high as 45 or 50 degrees to hold the sign 24 well above the barrier 4. While in use the spacer 50 may be attached to the housing bracket 30 by fasteners or glue, present experience indicates that it is preferable to allow the spacer to float under the arm, with the tapering walls 50*c* preventing the spacer from being removed. Because the end portions 50*a* are thicker than the distance between the bottom of the arm and the top surface of the bottom plate of the housing bracket, the end portions 50*a* hold the piece of material in place without the need for adhesive, etc. The piece of material can be adhesively attached or attached to the housing bracket by a bolt, etc., if such is necessary to avoid vandalism/theft, but such does not presently appear to be a problem.

The spacer 50 may be anywhere from one inch to eight inches (2.54 to 20.32 cm) wide depending on the sign at issue, though between 1.5 and four inches (3.81 and 10.16 cm) is most common. Thus, for example, one preferred embodiment has the ends being three inches (7.62 cm) wide and 2 inches (5.08 cm) thick.

Turning now to FIGS. 10 and 11, there is shown another spacer 50. The spacer 50 may have a void 54 for receiving a bolt. The spacer 50 may also have a washer 64 which may include a collar 62 to engage the material of the spacer-whether rubber like or generally rigid. This enables that the spacer 50 can be secured to the housing bracket with the same bolts used to hold the housing bracket to the jersey barrier as shown in FIG. 12. The spacers 50 may be placed on both sides of the arm 20 so that a spacer engages an arm with either direction it falls. If the spacer gets damaged, it can be replaced by simply removing the bolt, replacing the spacer, and reinserting the bolt. Different height spacers can be used to ensure that the sign is held sufficiently high that it is noticeable to drivers and, when possible, to be positioned above the height of most vehicles.

While a wide range of materials can be used, the currently preferred material for making the spacer is ballistic rubber, although natural rubber, styrene-butadiene rubber, butyl rubber, nitrile, Neoprene®, ethylene propylene diene monomer, silicone, Vitron®, hydrated nitrile and polyurethan are examples of other rubber like compounds that would also work well. The material is preferably durable and should function in both hot and cold climates. It will also be appreciated that the spacer can be formed in layers and the layers need not be made out of the same material.

Figure 13:
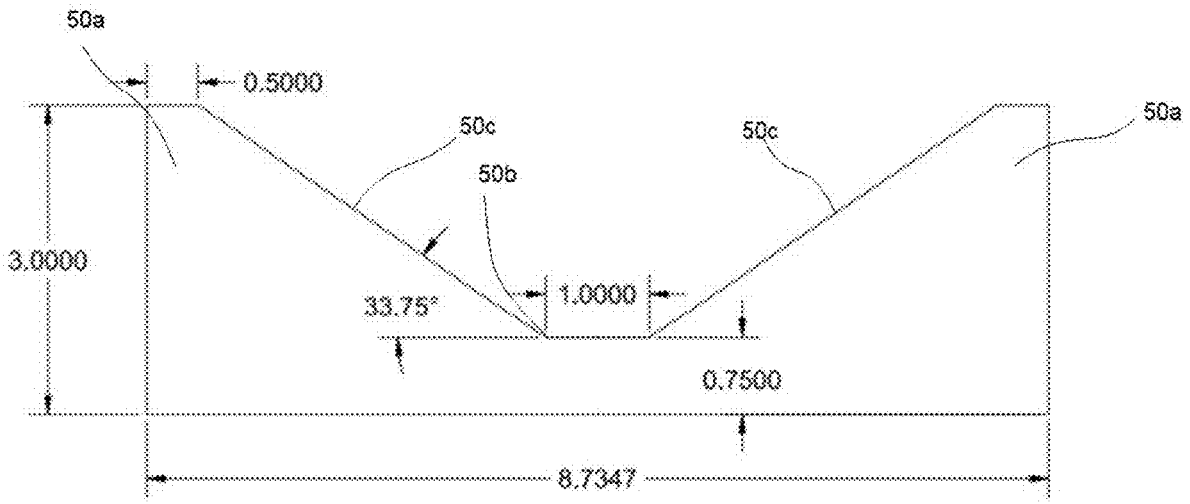
FIG. 13 shows a side view of a spacer designed to hold a sign or arm at and upward angle of between about 30 and 50 degrees.

Turning now to FIG. 13, there is shown a presently preferred embodiment. The spacer 50 may be between 8 and 9 inches long (20.32-22.86 cm) and approximately 3 inches (7.62 cm) tall at the ends which extend approximately 0.5 inches (1.27 cm), and then extend downwardly at a slopes 50*c* of between 30 and 50 degrees (and most preferably 33.75 Degrees) to the middle portion 50*b*, which is 0.75 inches (1.91 cm) tall and extends for about 1 inch (2.54 cm).

Thus, there is disclosed a roadway safety device and method for using the same. It will be appreciated that modifications can be made without departing from the scope and spirit of the invention. The appended claims are intended to cover such modifications.

What is claimed is:

1. A roadway safety device comprising:

a bracket, an arm pivotably attached to the bracket and pivotable between a generally vertical position and a horizontal position, and at least one spacer disposed in the bracket wherein the at least one spacer is separated from the arm by a void when the arm is disposed in the generally vertical position, and wherein the arm impacts the spacer so as to stop movement of the arm if the arm attempts to move to the horizontal position and wherein the spacer if formed by an elongate piece of resilient material having a first middle portion having a thickness and a first end portion and a second end portion, and wherein the first end portion and second end portion are between two and 10 times the thickness of the middle portion.

2. The roadway safety device of claim 1, wherein the piece of material is between 6 and 18 inches long.

3. The roadway safety device of claim 1, wherein the piece of material wherein the middle portion is between 0.5 inches and 1.5 inches thick and wherein the end portions are between 3 inches and 6 inches thick.

4. The roadway safety device of claim 3, wherein the spacer comprises a first end portion, a second end portion and a middle portion and wherein the middle portion is thinner than the end portion.

5. The roadway safety device of claim 1, wherein the bracket comprises a bottom wall and a sidewall extending up from the bottom wall, and wherein the spacer is disposed on the bottom wall and wherein the arm is pivotably attached to the sidewall.

6. The roadway safety device of claim 5, and wherein the bottom wall is flat and wherein the spacer has a flat bottom which lays on the flat bottom wall of the bracket.

7. The roadway safety device of claim 5, wherein the roadway safety device comprises a shear bolt extending through the sidewall and into the arm to hold the arm vertical until sheared and such that the arm does not touch the spacer until the shear bold has been sheared.

8. A method for improving the safety of a roadway sign attached on top of a barrier, the method comprising:

selecting a roadway sign which is attached to an arm which is pivotably mounted to a housing bracket so that the arm pivots from a vertical position and a generally horizontal position;

disposing a resilient spacer adjacent to and underneath the arm and spaced away from the arm such that if the arm rotates, the arm impacts the spacer, the spacer absorbing force from the rotating arm and limiting rotation of the arm to prevent the arm or sign from engaging the barrier.

9. The method according to claim 8, wherein the housing bracket is attached to a concrete barrier, the bracket having a bottom wall and wherein the method comprises laying the spacer on top of the bottom wall so the spacer is disposed in the housing bracket to engage the arm if the arm rotates toward a horizontal orientation so as to prevent the arm from being disposed horizontal.

10. The method according to claim 9 wherein the spacer includes an elongate piece of material having a middle portion and end portions, the end portions having a portion which is at least twice as thick as the middle portion, and wherein the method comprises positioning the piece of material under the arm with one end portion being disposed on one side of the arm and another end portion being disposed on an opposing side of the arm.

11. The method according to claim 10, wherein the end portions of the piece of material have a thickness which is greater than a distance between the bottom of the arm and the housing bracket so that end portions hold the piece of material in place on the bottom wall of the bracket without the need for adhesive.

12. The method according to claim 8 wherein the spacer is attached to the bottom wall of the housing bracket.

13. The method according to claim 12, wherein the spacer is attached to the bottom wall of housing bracket on one side of the arm and wherein a second spacer is attached to the bottom wall of the housing bracket on a second side of the arm.

14. The method according to claim 8, wherein the method comprises using a shear bolt to hold the arm generally vertically and wherein the arm does not come into contact with the spacer until the shear bolt has been sheared.

15. A method for improving the safety of fallen roadway signs, the method comprising:

selecting a roadway sign attached by an arm to a housing bracket wherein the arm pivots with respect to the housing bracket;

disposing a spacer in the housing bracket but spaced away from the arm so as to limit rotation of the arm relative to the housing bracket so that the roadway sign is held above horizontal.

16. The method according to claim 15, wherein the housing bracket has a bottom wall and wherein the method includes disposing the spacer on the bottom wall of housing bracket disposed on a concrete barrier, the spacer being sufficiently tall on one side of the arm so as to prevent the arm from impacting the concrete barrier if the arm rotates toward horizonal.

17. The method according to claim 16, wherein there the method comprises disposing the spacer on the bottom wall of the housing bracket so that the spacer extends upwardly sufficient to maintain the arm at an upward slope of at least 20 degrees above horizontal once the arm has impacted the spacer.

18. A roadway safety device comprising:

a bracket having a bottom wall and a pair of sidewalls extending upwardly from the bottom wall;

an arm pivotably attached to at least one of the side walls;

a sheer bolt attached to at least one of the side walls for preventing pivoting of the arm unless the sheer bolt is sheered; and a spacer disposed in the bracket for limiting the pivoting of the arm, the spacer being spaced apart from the arm until the shear bolt is sheared and the arm rotates into engagement with the spacer.

19. The roadway safety device of claim 18, wherein the spacer is disposed on the bottom wall of the bracket.

20. The roadway safety device of claim 18, wherein the spacer is positioned to be impacted by the arm and thereby prevent the arm from rotating from generally vertical to a position closer than 20 degrees from horizontal.

* * * * *